US005887473A

United States Patent [19]

Hawkes

[11] Patent Number: 5,887,473

[45] **Date of Patent: *Mar. 30, 1999**

[54] CONTINUOUS EXTRUSION APPARATUS

[75] Inventor: Daniel John Hawkes, Ashford, England

[73] Assignee: BWE Limited, Kent, England

[ * ] Notice: This patent issued on a continued prosecution application filed under 37 CFR 1.53(d), and is subject to the twenty year patent term provisions of 35 U.S.C. 154(a)(2).

[21] Appl. No.: 612,872

[22] PCT Filed: Jul. 13, 1995

[86] PCT No.: PCT/GB95/01654

§ 371 Date: Jul. 9, 1996

§ 102(e) Date: Jul. 9, 1996

[87] PCT Pub. No.: WO96/02335

PCT Pub. Date: Feb. 1, 1996

[30] Foreign Application Priority Data

Jul. 15, 1994 [GB] United Kingdom ..... 9414322

[51] Int. Cl.[6] ..... B21C 23/00

[52] U.S. Cl. ..... 72/262

[58] Field of Search ..... 72/262, 270, 271, 72/272, 253.1

[56] References Cited

U.S. PATENT DOCUMENTS

| | | | |
|---|---|---|---|
| Re. 18,710 | 1/1933 | Dunsheath | 72/262 |
| 2,108,529 | 2/1938 | Dunsheath | 72/262 |
| 2,726,761 | 12/1955 | Larsen | 72/262 |
| 4,055,979 | 11/1977 | Hunter et al. | 72/262 |
| 4,277,968 | 7/1981 | Pardoe . | |
| 4,566,303 | 1/1986 | McKenna | 72/262 |

FOREIGN PATENT DOCUMENTS

| | | | |
|---|---|---|---|
| 575752 | 5/1959 | Canada | 72/262 |
| A-71490 | 2/1983 | European Pat. Off. . | |
| 4224014 | 8/1992 | Japan | 72/262 |

*Primary Examiner*—Joseph J. Hail, III
*Assistant Examiner*—Ed Tolan
*Attorney, Agent, or Firm*—Shlesinger, Arkwright & Garvey LLP

[57] ABSTRACT

Continuous extrusion apparatus having a rotating circumferential groove (72) carrying feedstock to a passageway formed between the groove and arcuate tooling extending into the groove has the groove formed on the central region (72) of a cylinder (2). The cylinder (2) is formed with end bosses (16, 18) which are supported in bearings (4) such that deflection arising from generating very high extrusion pressures in the passageway is minimised and stresses are distributed to the bearings (4) in a manner avoiding concentrations or the incidence of unacceptably high variations in local stress levels. The cylinder (2) is end connected to a drive shaft (24) outboard of the bearing (4) with a splined end portion (22) of the drive shaft locating in an end recess (20) in the cylinder (2). Alternatively a bolted connection may be used. A tie bolt (36) extends coaxially of the cylinder (2) and serves to apply a compressive axial loading to the cylinder to counter tension stresses arising during extrusion. The bearings (4) include rollers (48) directly in contact with the end bosses (16, 18) of the cylinder, the cylinder being free to expand axially relative to one set of rollers (48). Cooling and lubricating fluid is supplied to the bearings (4) and end bosses (16, 18). Coolant may also be directed through passages lined with copper sleeves extending axially of the cylinder (2). The bearing surfaces on the bosses (16, 18) and the central region (70) of the cylinder (2) are formed as regions of increased hardness relative to the remainder of the cylinder.

13 Claims, 1 Drawing Sheet

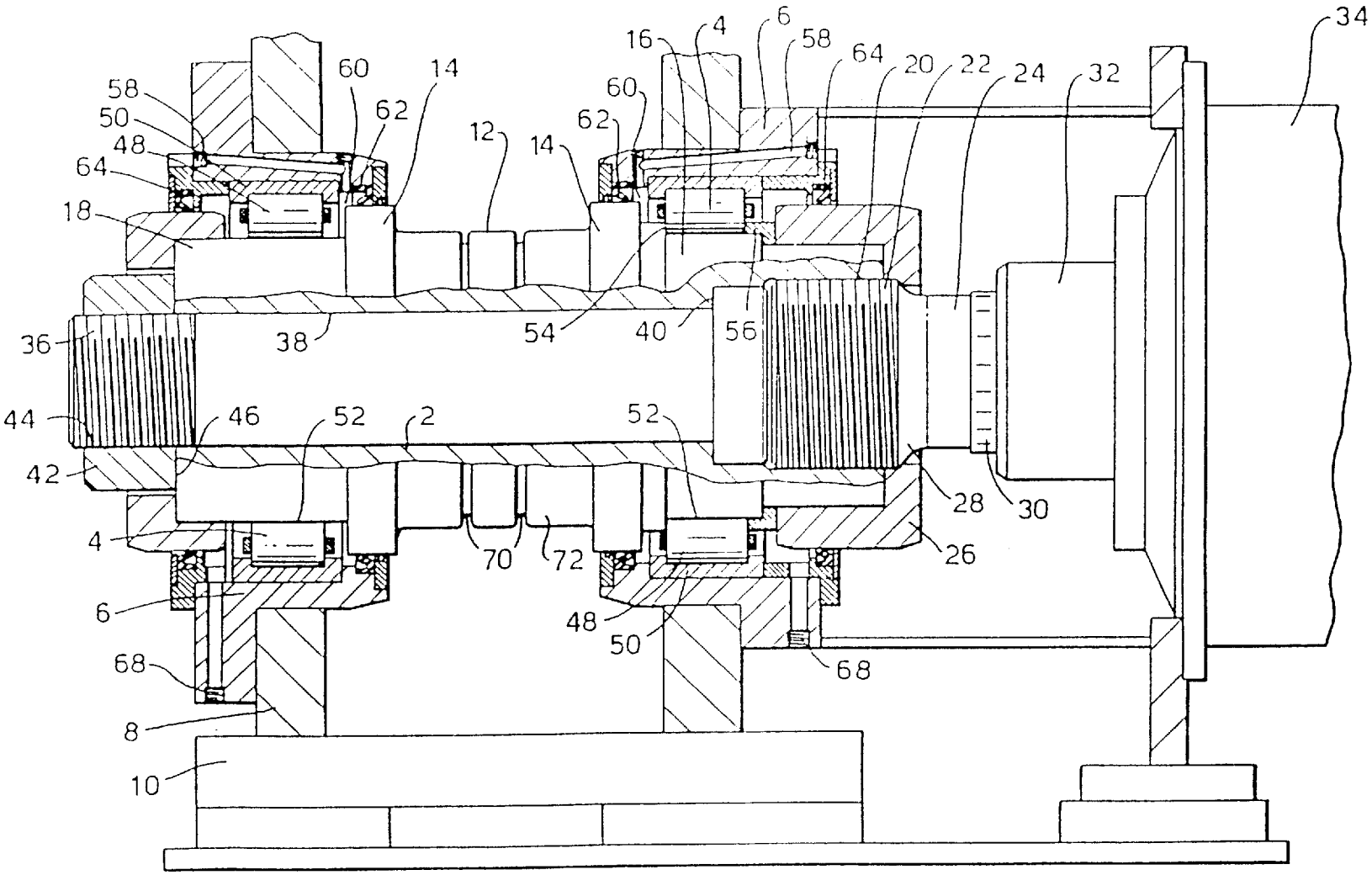
34
32
24
22
20
64
58
6
4
16
60
62
14
12
14
62
60
58
50
48
64
18
36
44
42
4
6
68
8
10
30
28
26
68
56
40
54
52
50
48
72
70
2
52
38
46

CONTINUOUS EXTRUSION APPARATUS

This invention relates to apparatus for the forming of metals by a continuous extrusion process in which feedstock is introduced into a rotating circumferential groove to pass into a passageway formed between the groove and arcuate tooling extending into the groove.

In EP-A-0 071 490 there is described continuous extrusion apparatus utilising circumferentially grooved means rotatably mounted on a bed.

According to the present invention, there is provided a continuous extrusion apparatus utilising circumferentially grooved means rotatably mounted on a bed, wherein the circumferentially grooved means comprises a circumferentially grooved cylinder carried on bearings on the bed and end coupled to a drive shaft.

In order to exploit fully the continuous extrusion forming process, very high extrusion pressures are utilised such that very high levels of stress are generated. Hitherto to operate the process a circumferentially grooved wheel mounted on a drive shaft running in associated bearings has been utilised. However, the wheel tends to orbit relative to the shaft and to deform which may lead either to damage or early failure of the wheel assembly or leakage of feedstock material and loss of extrusion pressure due to deflection of the wheel assembly under load, or both. Where the wheel is keyed or splined to the shaft, the orbiting effect may lead to fretting at the keys or splines, again leading to possible early failure.

The invention will now be described, by way of example, with reference to the accompanying, partly diagrammatic, partially axially cross-sectioned, portion of a continuous extrusion apparatus.

As shown, a circumferentially grooved cylinder 2 is mounted in bearings 4 positioned in bushes 6 carried in a frame 8 positioned on a bed 10. The cylinder is formed with a central, circumferentially grooved, portion 12 flanked by a pair of circumferential flanges 14 and a pair of outer, end, bosses 16, 18. One end boss 16 is formed with a splined recess 20 arranged to co-act with a correspondingly splined end portion 22 of a coupling shaft 24. A retaining ring 26 bears against a shoulder 28 on the coupling shaft to retain the splined end portion 22 in the splined recess 20. The other end portion 30 of the coupling shaft is splined into an output drive 32 of a gear box 34 connected to an electric motor (not shown). In an alternative arrangement (not shown) the coupling shaft is bolted to an end face of the circumferentially grooved cylinder 2.

As shown, a pre-loading tie bolt 36 is positioned centrally of a bore 38 in the cylinder 2 from a base portion 40 of the splined recess 20 to the end boss 18 and is provided with a nut 42 co-acting with a threaded portion 44 of the tie bolt. Compressive stress is induced in the cylinder by tightening the nut 42 on the tie bolt 36 against an end face 46 of the boss 18, in order that, when the apparatus is in operation and a radial loading is applied through arcuate tooling urged into contact with the cylinder 2 over a short arc, the resultant stress loading in the cylinder 2 is nontheless maintained as compressive around the full circumference. However, it is envisaged that, in some instances, it will not be necessary to apply such a compressive pre-stressing and that fabricating the cylinder 2 as a solid integer will provide a sufficiently rigid arrangement. Whilst the fatigue life of the solid cylinder may be less than the fatigue life of a pre-loaded wheel mounted on a shaft, this is not considered to be disadvantageous overall since all the material subject to high stress levels is replaced when it becomes necessary to replace a wheel and the reduced fatigue life of the present arrangement is likely to be greater than the wear out life of a wheel arrangement.

The bearings 4 include a multiplicity of rollers 48 running in a radially outer raceway 50 mounted on the bushes 6. The rollers 48 run directly on the faces 52 on the cylinder 2, with the cylinder being located axially by positioning the rollers at the boss 16 between a shoulder 54 on the cylinder 2 and a flanged ring 56 held in position by the retaining ring 26. To accommodate axial thermal expansion, the boss 18 is free to move axially of the rollers 48.

Each bush 6 is formed with an inlet duct 58 for the supply of lubricating and cooling fluid to the bearing 4. The inlet duct 58 discharges to a circumferential chamber 60 formed between the bush 6 and the respective end boss 16, 18 and flexible end seal means 62, 64. An outlet duct 68 extends from the chamber 60 through the bush 6. In order to extract heat from the bosses 16, 18 and to lubricate the rollers 48, a fluid, such as an oil or a water based emulsion, is circulated through the inlet ducts 58 to the circumferential chambers 60 and discharged to a cooler means (not shown) through the outlet ducts 68.

In an alternative arrangement (not shown) coolant is directed to flow over the surface of end regions of the cylinder 2 and a separate flow of lubricant is directed to the bearings 4.

In another alternative arrangement (not shown) interconnected axial passages are drilled in the cylinder 2, adjacent the cylindrical surface, and are channelled to a co-axial distributor and collector means adjacent the boss 18. The axial bores may be lined with, for example, expanded copper sleeves to reduce thermal shock and increase heat extraction rates.

The central portion 12, as shown, is formed with a pair of grooves 70, which, if desired, are positioned in a region 72 of increased hardness as compared with the hardness of the remainder of the cylinder 2. The region of increased hardness may be achieved, or subsequently reclaimed, for example, by forming the solid cylinder with an insert of harder material, by utilising an induction heating and hardening process, by laying down a weld deposit of harder material, by metal spraying, by nitriding, by diffusion techniques or by ion implantation. Regions of the end bosses 16, 18 in registration with the rollers 48 may be hardened in a similar manner. It will be appreciated that but a single circumferential groove may be provided or, alternatively, several circumferential grooves may be provided.

By virtue of the coupling between the solid cylinder 2 and the output drive shaft 32 of the gear box 34 being located outboard of the center of the bearing 4, torque is transmitted through a connection not subject to radial loading, thereby avoiding drawbacks inherent in the previous arrangements, Since the cylinder carries the circumferential grooving directly, the radial loading is transmitted directly to the support bearings thereby achieving a highly rigid assembly which is not subject to orbiting.

I claim:

1. A continuous extrusion apparatus having a circumferentially grooved member rotatably mounted on a bed, said circumferentially grooved member comprises:

a) circumferentially grooved cylinder having first and second ends, said circumferentially grooved cylinder carried on bearings for rotational movement on said bed and end coupled at one of said first and second ends to a drive shaft, said end coupling is outboard of said bearings.

2. A continuous extrusion apparatus as claimed in claim 1, and wherein said circumferentially grooved cylinder is formed as a solid integer.

3. A continuous extrusion apparatus as claimed in claim 1, and wherein said circumferentially grooved cylinder is formed with a central, axially extending, through bore, a tie bolt is located in said through bore and provided with a nut arranged to apply a compressive axial loading to said circumferentially grooved cylinder.

4. A continuous extrusion apparatus as claimed in claim 1, and wherein said first and second ends of said circumferentially grooved cylinder is formed with a splined recess arranged to coact with a splined end portion of said drive shaft.

5. A continuous extrusion apparatus as claimed in claim 1, and wherein said bearings include rollers arranged to run in tracks mounted in bushes positioned on said bed and to run in contact with end bosses formed on said circumferentially grooved cylinder.

6. A continuous extrusion apparatus as claimed in claim 5, and wherein axial movement of said circumferentially grooved cylinder relative to said rollers is constrained at one of said end bosses with the other of said end bosses being free to move axially relative to the respective one of said rollers to accommodate axial thermal expansion of said circumferentially grooved cylinder.

7. A continuous extrusion apparatus as claimed in claim 1, and further including means for supplying a cooling fluid to flow over end region surfaces of said cylinder.

8. A continuous extrusion apparatus as claimed in claim 1, and further including means for supplying a cooling and lubricating fluid to said bearings to flow in contact with said end portions of said circumferentially grooved cylinder.

9. A continuous extrusion apparatus as claimed in claim 1, and further including axially extending passages for the flow of cooling fluid formed in said circumferentially grooved cylinder and connected to a co-axial connector at one end of said cylinder.

10. A continuous extrusion apparatus as claimed in claim 9, and further including sleeves of a metal of relatively high thermal conductivity expanded into contact with wall portions of said passages for flow of cooling fluid.

11. A continuous extrusion apparatus as claimed in claim 1, and wherein at least a portion of the grooving formed within said circumferentially grooved cylinder is of a material having a hardness greater than about the hardness of the remaining portion of said cylinder.

12. A continuous extrusion apparatus comprising:

a) a base;

b) a circumferentially grooved cylinder having first and second ends;

c) bearings for rotatably mounting said circumferentially grooved cylinder to said base, said bearings provided at each of said first and second cylinder ends; and d) a drive shaft for connection to said circumferentially grooved cylinder at one of said first and second ends, said connection is outboard of said bearings.

13. A continuous extrusion apparatus comprising:

a) a support bed;

b) a circumferentially grooved forming member having first and second ends;

c) means for rotatably mounting said circumferentially grooved forming member to said bed, said mounting means provided at each of said first and second ends;

d) means for rotating said circumferentially grooved forming member; and e) means for connecting said rotating means to one of said circumferentially grooved forming member first and second ends, said connecting means is outboard of said mounting means.

* * * * *